United States Patent [19]

David

[11] Patent Number: 4,995,942

[45] Date of Patent: Feb. 26, 1991

[54] EFFECTIVE NEAR NEUTRAL PH ETCHING SOLUTION FOR MOLYBDENUM OR TUNGSTEN

[75] Inventor: Lawrence D. David, Wappingers Falls, N.Y.

[73] Assignee: International Business Machines Corporation, Armonk, N.Y.

[21] Appl. No.: 516,845

[22] Filed: Apr. 30, 1990

[51] Int. Cl.[5] ..... B44C 1/22; C23F 1/00; C09K 13/00

[52] U.S. Cl. ..... 156/642; 156/656; 156/664; 252/79.1; 252/79.2; 252/79.5

[58] Field of Search ..... 252/79.1, 79.2, 79.4, 252/79.05; 156/642, 656, 659.1, 664; 437/228, 245; 134/3, 10, 41

[56] References Cited

U.S. PATENT DOCUMENTS 4,747,907 5/1988 Acocelia et al. ..... 156/642

OTHER PUBLICATIONS

L. D. David, et al., "Ozone Reoxidation of a Ferrieyanide Bath for Etching Molybdenum" Metal FInishing, pp. 47–49 (May 1988).

Tsigdinos, "Heteropoly Compounds of Tungsten and Molybdenum" Topics in Current Chemistry, 76 (Springer-Verlay, 1978).

*Primary Examiner*—William A. Powell

*Attorney, Agent, or Firm*—Ira David Blecker

[57] ABSTRACT

A neutral or near neutral pH etching solution for effectively etching molybdenum and tungsten including: an aqueous ferricyanide ion solution, a soluble molybdate or tungstate, and an essential compound such that upon combination of said soluble molybdate or tungstate and said essential compound, a heteropoly compound is formed in which said essential compound contributes at least one heteroatom to said heteropoly compound.

The etching solution is most preferably used for etching molybdenum or tungsten which is adhered or proximate to a base-sensitive material.

21 Claims, No Drawings

EFFECTIVE NEAR NEUTRAL PH ETCHING SOLUTION FOR MOLYBDENUM OR TUNGSTEN

FIELD OF THE INVENTION

This invention relates to the field of etching solutions for refractory metals such as molybdenum and tungsten. More particularly, this invention relates to those etching solutions which can effectively etch molybdenum and tungsten at nearly neutral pH.

BACKGROUND OF THE INVENTION

Various etchants are well known for etching molybdenum and tungsten. For example, molybdenum may be easily etched in ferricyanide solutions as disclosed in Acocella et al., U.S. Pat. No. 4,747,907, the disclosure of which is incorporated by reference herein. Similarly, tungsten may be etched by a mixture of hydrogen peroxide and aqueous ammonia. This tungsten etchant, however, has a shelf life of only about 8 hours. Tungsten etches very slowly, if at all, in ferricyanide solutions.

For many purposes, the performances of these etchants are acceptable. These etchants, however, are not satisfactory in some applications.

To illustrate this, the etching of molybdenum is typically effected in a strongly alkaline solution of ferricyanide:

$$6Fe(CN)_6^{3-} + Mo + 8OH^- \rightarrow 6Fe(CN)_6^{4-} + MoO_4^{2-} + 4H_2O$$

The pH of such an etchant solution is typically maintained between about 12.0 and 13.0 and temperature at about 50–55 degrees Centigrade.

David and Kurdziel, "Ozone Reoxidation of a Ferricyanide Bath for Etching Molybdenum," *Metal Finishing, p.* 47–49 (May 1988), have deduced the rate law for ferricyanide etching of molybdenum. It was concluded that by enhancing a ferricyanide solution with molybdate and by buffering the solution to control pH, good etching results may be obtained. It was necessary to maintain the pH at a relatively high level, 12.0 to 12.5.

One such application where this etchant would be unsatisfactory is when the molybdenum, for example, is incorporated in a laminate structure which is comprised of the metal and a base-sensitive low dielectric constant polymer such as a polyimide. These types of polymers will hydrolyze in strong bases and thus cannot survive current methods of etching molybdenum.

It would thus be desirable to have an etchant for molybdenum, and tungsten as well, which has a lower pH that will not adversely affect base-sensitive materials.

Lowering the pH of a molybdenum etchant, however, is not a trivial process. If the pH of a ferricyanide etch bath drops below about 10–11, the molybdenum blackens due to the formation of polymolybdates as follows:

$$n\,MoO_4^{2-} + m\,H^+ \rightleftharpoons Mo_nO_{4n-m/2}^{m-2n} + \frac{m}{2}H_2O$$

This stops the etching process completely.

Thus, a low pH etching process for molybdenum must preserve the etching rate and suppress the formation of undesirable molybdate polymer residues, as well as not hydrolyze companion polymers in the laminate or composite structure.

It has been discovered, however, that the pH may in fact be lowered in a molybdenum etchant solution without slowing down the etching rate and while suppressing the formation of undesirable molybdate polymer residues. It has also been discovered that the pH may be lowered for a tungsten etchant solution as well. The key is in the formation of heteropoly compounds, a class of compounds known in the literature for many years. See, for example, Tsigdinos, "Heteropoly Compounds of Tungsten and Molybdenum" in *Topics In Current Chemistry*, 76 (Springer-Verlag, 1978), the disclosure of which is incorporated by reference herein.

Accordingly, it is a prime object of the present invention to have a near neutral pH etching solution for effectively etching molybdenum and tungsten.

It is a further object of the invention to have a near neutral pH etching solution that is capable of being recycled.

BRIEF SUMMARY OF THE INVENTION

The objects of the invention have been achieved by providing, according to one aspect of the invention, a neutral or near neutral pH etching solution for effectively etching molybdenum and tungsten comprising: an aqueous ferricyanide ion solution, a soluble molybdate or tungstate and an essential compound such that upon combination of said soluble molybdate or tungstate and said essential compound, a heteropoly compound is formed in which said essential ingredient contributes a heteroatom or heteroatoms to said heteropoly compound.

According to another aspect of the invention, there is provided a method of effectively etching molybdenum or tungsten from a composite material comprising molydenum or tungsten adhered to a base-sensitive material without damaging the material comprising the steps of: contacting the composite with a neutral or near neutral pH etching solution comprising: an aqueous ferricyanide ion solution, a soluble molybdate or tungstate, and an essential compound such that upon combination of said soluble molybdate or tungstate and said essential compound, a heteropoly compound is formed in which said essential compound contributes a heteroatom or heteroatoms to said heteropoly compound.

DETAILED DESCRIPTION OF THE INVENTION

The key to the present invention is to form heteropolymolybdates and heteropolytungstates as part of the etching process of molybdenum and tungsten, respectively. Generally, heteropoly compounds have been known for years. The novel aspect of the present invention is to apply these heteropoly compounds to the current needs of improving the etching of molybdenum and tungsten.

The heteropoly compounds generally consist of two to eighteen hexavalent molybdenum or tungsten atoms surrounding one or more central atoms (heteroatoms). Often vanadium, niobium, tantalum, or other transition metals can replace some of the molybdenum or tungsten atoms in the heteropoly structure.

In the case of molybdenum etching with a ferricyanide solution, the heteropoly compound may be formed by combining in solution a soluble molybdate and an essential compound that contributes at least one heteroatom to the formed heteropolymolybdate. A preferred soluble molybdate is sodium molybdate and a preferred essential compound, for purposes of the present invention, is phosphoric acid. As will become apparent hereafter, there are a number of essential compounds that may be utilized. The appropriate one chosen will often depend on the intended application.

It should be understood that some of the soluble molybdate $$(MoO_4^{2-})$$

necessarily comes from the etching and dissolution of the molybdenum. The bulk of the soluble molybdate, however, preferably (and usually) comes from the addition to the etching solution of soluble molybdates such as sodium molybdate.

One example of the formation of heteropolymolybdates is the following reaction:

$$24H^+ + 12MoO_4^{2-} + PO_4^{3-} \rightarrow [PMo_{12}O_{40}]^{3-} + 12H_2O$$

where phosphorus is the heteroatom contributed by the phosphoric acid, the essential compound. The fact that the phosphoric acid is an essential compound will become apparent hereafter. This reaction may take place at room temperature as well as at elevated temperatures.

There are literally hundreds of these heteropolymolybdates. The heteroatom may alternatively be, for example, silicon, germanium, sulfur, aluminum, nickel, manganese, arsenic, titanium, zirconium, etc. Those heteropolymolybdates which include phosphorus are among the most easily synthesized and so are preferred. Some examples of other heteropolymolybdates are $$[X^{+n}Mo_{12}O_{42}]^{n-12},\ [X^{+n}Mo_{11}O_{39}]^{n-12},\ [X^{+n}Mo_{10}O_y]^{-(2y-60-n)}$$

where X + n can be $Si^{+4}$, $Ge^{+4}$, $Al^{+3}$, $Ni^{+4}$, etc.

As an example, the above reaction may proceed with sulfurous acid instead of phosphoric acid, in which case the heteroatom will be sulfur. The heteropolymolybdate has the general formula $[SMo_xO_y]^{6(x+1)-2y}$, and one specific heteropolymolybdate is $[SMo_{12}O_{40}]^{2-}$. The ease of using common liquid-phase acids as sources of heteroatoms favors the usage of phosphoric acid and sulfurous acid. Phosphoric acid, which emits no volatile gas, is easier to handle than sulfurous acid, which emits sulfur dioxide, and so is preferred over sulfurous acid.

It bears emphasis that the heteroatom source (i.e., the essential compound) need not be an acid. For example, one could add phosphate as sodium phosphate, sulfite as sodium sulfite, or arsenic as sodium arsenate. The acids (e.g., phosphoric or sulfurous acid) are convenient liquids to use, but other heteroatom sources will also suffice.

These polyions are amazingly soluble; their salts can be dissolved in only a fraction of their weight in water. This fulfills a basic condition of etching any metal, to wit, the etched product must remain soluble.

Conventional etching of molybdenum in ferricyanide solutions normally requires a high pH of about 12 to 12.5, and perhaps as high as 13 to maintain the soluble molybdenum species as $$MoO_4^{2-}.$$

Also, etching typically takes place at elevated temperatures, about 55 degrees Centigrade. With the present invention, molybdenum is maintained as a soluble polymolybdate at nearly neutral pH and etching may proceed at room temperature. Of course, etching according to the present invention may also proceed at elevated temperatures if higher etch rates are desired.

As will be appreciated by those skilled in the art, it usually be necessary to introduce a charge balancing species into the reaction. The choice of charge balancing species is not critical although the introduction of undesirable stray ions such as chlorine should be avoided if possible. Preferred charge balancing species include sodium, potassium, and ammonium ions, which may be added by their hydroxides, phosphates, or molybdates. Of course, this list of charge balancing species is not exhaustive and may include other charge balancing species as well.

In view of the presence of analogous tungsten heteropolyions, it was theorized by the present inventor that similar efficacious results could be obtained in the etching of tungsten. When a solution of ferricyanide, sodium tungstate, and phosphoric acid was formulated and used to etch tungsten, favorable results similar to those obtained in the etching of molybdenum were obtained at nearly neutral pH. Interestingly, a ferricyanide solution alone would not etch tungsten to any practical degree.

An important application of the present invention is to etch molybdenum or tungsten from a laminate comprising molybdenum or tungsten and base-sensitive materials such as polyimide polymers. The molybdenum or tungsten may be adhered directly to the base sensitive materials or may be merely proximate to the base sensitive materials. The laminate may also comprise additional metals such as copper. It was found that the molybdenum or tungsten may be etched from polyimide, for example, without causing any degradation of the polyimide material or additional metal since the optimal pH range for the etchants according to the invention is about 6 to 8.

Further advantages of the present invention will become more apparent after referring to the following examples.

EXAMPLES

In the following examples, all reagents were used as received from the vendor with no further purification. Potassium ferricyanide was obtained from Duso Chemical Co. (Poughkeepsie, N.Y.). Sodium tungstate dihydrate, sodium molybdate dihydrate, sodium borate (Borax), sodium hydroxide, and potassium hydroxide were obtained from Mallinckrodt, Inc. Phosphoric acid was obtained from Ashland Chemical and sulfurous acid was obtained from Fisher Scientific. Deionized water was used in all etching solutions.

EXAMPLE 1

73 grams of potassium ferricyanide ($K_3Fe(CN)_6$) and 60 grams of sodium molybdate dihydrate ($Na_2MoO_4 \cdot 2H_2O$) were dissolved in 500 milliliters of deionized water. The pH of the solution was 8.55. A sheet of molybdenum metal weighing 1.6705 grams was immersed in this stirred etchant at room temperature (20 degrees Centigrade). In 28 minutes, the pH had dropped to 6.98 and the molybdenum was coated with a black layer which could not be rinsed away. After etching, the molybdenum sheet weighed 1.6557 grams, a net loss of 14.8 milligrams.

EXAMPLE 2

73 grams of potassium ferricyanide and 60 grams of sodium molybdate dihydrate were dissolved in 500 milliliters of deionized water. 3 milliliters of phosphoric acid ($H_3PO_4$) were added, followed by addition of sufficient quantities of potassium hydroxide (KOH) pellets (about 5 grams) to raise the pH to 7.57. A molybdenum sheet weighing 1.5483 grams was suspended in this solution at room temperature. In 30 minutes, the molybdenum sheet weighed 1.5112 grams for a net loss of 37.1 milligrams. The molybdenum had an orange coloration but this rinsed off easily with water to leave a shiny surface.

EXAMPLE 3

The phenomenon of Example 2 is not due to pH alone as this example will illustrate. 73 grams of potassium ferricyanide, 60 grams of sodium molybdate dihydrate and 5 grams of borax (sodium borate) were dissolved in 500 milliliters of water. The pH of the solution was 9.52. A molybdenum sheet weighing 2.2579 grams was immersed in this etchant. After 27 minutes, the pH had dropped to 7.0 and the molybdenum sheet had blackened. Addition of potassium hydroxide pellets raised the pH to 9.42 but did not dissolve the black coating nor did it render the coating rinsable. Immersion of the molybdenum sheet in the etchant for another 20 minutes caused the pH to drop to 9.3. Next, 5.1 more grams of borax was added. The sheet was immersed for 25 more minutes, in which time the pH dropped further to 8.7. The mass of the sheet was 2.2436 grams after a total of 72 minutes of etching, a loss of only 14.3 milligrams.

EXAMPLE 4

To the solution in Example 3, 3 grams of potassium hydroxide and 3 milliliters of phosphoric acid were added, which adjusted the pH to 7.85. This restored the etching potency of the solution. When the blackened molybdenum sheet was again immersed in the solution, the molybdenum sheet became shiny again. After 3 hours of immersion in this etchant, the molybdenum sheet became a mass of shredded debris. This example clearly indicates the unique role that the phosphoric acid plays in the etching of molybdenum.

The phosphate from the phosphoric acid reacted with the insoluble black molybdenum oxides on the surface of the molybdenum sheet, forming heteropolymolybdates and allowing the etching to proceed. It is the formation of these phosphomolybdate polyions which accounts for the etching performance observed. Under the above conditions, the borax did not incorporate any heteroatoms into a molybdate polyion, and thus did not effect any etching.

EXAMPLE 5

A solution of 60 grams of sodium molybdate dihydrate and 3 milliliters of phosphoric acid in 500 milliliters of deionized water was adjusted to pH 7.31 by the addition of potassium hydroxide pellets. No weight loss was observed after 54 minutes of immersion of a sheet of molybdenum, a control experiment which indicated that the combination of phosphoric acid (phosphate) with molybdate did not etch molybdenum.

EXAMPLE 6

To the solution of Example 5, 73 grams of potassium ferricyanide was added, wherein the pH rose to 7.73. A 36.5 micron thick sheet of molybdenum laminated to a 14 micron thick cured, low-TCE polyimide sheet was placed in the stirred etchant. After 30 minutes, the pH had dropped to 7.65. After 17.5 hours, the pH had dropped to 7.59. No evidence of any precipitate was visible in the etchant. The polyimide film had survived intact and had retained its original clear yellow color, but the molybdenum was gone. The polyimide film exhibited no degradation even after 42 hours of continuous immersion in the etchant.

EXAMPLE 7

A polyimide/molybdenum composite with copper pads patterned between the polyimide layer and the molybdenum, similar to the composite in Example 6, was etched in a solution similar to Example 6. The composite was etched for 16 hours at room temperature at pH ranging from 7.77 at the beginning of the etching trial to 7.66 at the end. This removed the molybdenum from the composite, except for a few scattered bits of tenacious molybdenum metal. None of the copper pads had delaminated from the polyimide and the polyimide film exhibited no degradation from the etching process.

EXAMPLE 8

The etchant from Example 7 was used to etch 4.4693 grams of molybdenum sheets. After 11.75 hours, the etchant pH had fallen to 6.6 from 7.59 and a precipitate sludge had formed at the bottom of the beaker. Enough potassium hydroxide pellets were added to raise the pH back up to 7.61, which also dissolved the precipitate and which turned the solution a dark orange color. After 24.5 more hours of etching, 0.2034 grams of molybdenum had survived. The etchant was then treated with ozone (5 scf/hr, 5 psi overpressure; GL-1 Ozone Generator from PCI, West Caldwell, N.J.) for 25 minutes, which restored the potential to +460 millivolts and raised the pH back up to 12.95. This red etchant was titrated with phosphoric acid back to pH 7.78. The etchant has thus been recycled.

A molybdenum sheet weighing 2.2007 grams was etched for nine minutes in the regenerated etchant. During this time, the pH remained constant between 7.77 and 7.78, and the weight of the sheet decreased 25.2 milligrams.

The pH is occasionally adjusted during or after each ozone recycle with potassium hydroxide (or sodium hydroxide) pellets and/or phosphoric acid, or alkali metal phosphates. The addition of the acid (phosphate) is also necessary to form heteropolymolybdates from the newly dissolved molybdenum from prior etching runs.

EXAMPLE 9

Further evidence for the heteropolymolybdate mechanism is the versatility of formation of pH-neutral etchants with other heteroatom sources. Sulfurous acid can be used instead of phosphoric acid in this etchant system, which yields a solution of similar pH and performance.

73 grams of potassium ferricyanide and 66.17 grams of sodium molybdate dihydrate were dissolved in 500 milliliters of water, yielding a solution of pH 10.52. 0.8 milliliters of sulfurous acid ($H_2SO_3$) was added, which lowered the pH to 7.5. A strip of molybdenum metal weighing 2.1753 grams was immersed in the solution. After only six minutes, the pH had dropped to 7.28. Addition of 3.3 milliliters of sulfurous acid and 3 potassium hydroxide pellets (about one gram) raised pH back to 7.42. After 15 minutes of etching, the molybdenum strip was rinsed clean in an ultrasonic bath and weighed. The weight loss, 0.2599 grams, was 11.9% of the original strip.

The molybdenum was returned to the etchant. After one hour, the pH had dropped to 6.99 and the strip had acquired a black coating which could not be rinsed off. Four grams of potassium hydroxide pellets were added to the solution, which raised the pH to 7.16. The black layer could then be easily washed off in an ultrasonic bath of this etchant. The strip weighed 1.1188 grams, a 48.6% weight loss in one hour.

While the use of sulfurous acid to incorporate sulfur into the heteropolymolybdate has been demonstrated, the incorporation of other heteroatoms, such as arsenic, aluminum, silicon, etc., should also be feasible.

EXAMPLE 10

74.1 grams of potassium ferricyanide was dissolved in 500 milliliters of water, yielding an orange solution of pH 9.88. This solution failed to etch a strip of tungsten weighing 2.9338 grams in 30 minutes. 100.1 grams of sodium tungstate dihydrate ($Na_2WO_4 \cdot 2H_2O$) was then added, raising the pH to 10.25. After 30 minutes, the pH had dropped to 9.8 and the weight of the tungsten had decreased to 2.7358 grams for a net loss of 0.198 grams. While this etchant is satisfactory for some purposes the pH is still too high for base-sensitive materials.

Addition of 3 milliliters of phosphoric acid caused the immediate formation of a yellow precipitate in the etchant, and a small pH drop to 9.62. Addition of enough sodium hydroxide pellets to raise the pH to 13.38 did not dissolve this precipitate. More precipitate, this time chrome-yellow, formed on further addition of enough phosphoric acid to lower the pH to 3.2. When pH was raised to 4.67 with more sodium hydroxide pellets, some of the precipitate dissolved and the suspension turned mustard yellow. Addition of more sodium hydroxide raised the pH to 5.0 and cleared the suspension even more, turning the solution olive green, with some green residue still floating around in the etchant.

Over the next 3 days, the tungsten lost very little weight (less than 5 milligrams) at an etchant pH of less than or equal to 5.5. When the pH was raised to 5.95, weight loss recommenced; the tungsten strip lost 0.3079 grams in 75 minutes. Steady addition of sodium hydroxide pellets over the next 85 minutes raised pH up to 6.34, during which time the weight of the strip decreased another 0.1503 grams. Addition of sodium hydroxide pellets was continued, producing a steady increase in etch rate as the pH was raised, eventually ending at 7.0.

This etchant operated best in the range of about pH 6 to 8, yielding similar etch rates to those observed with the molybdenum etchant. As demonstrated, a ferricyanide solution alone would not etch tungsten. The addition of sodium tungstate was necessary in order to commence the etching reaction, which indicates that the tungstate ions play a similar, but even more decisive role in the ferricyanide etching of tungsten than molybdate does in molybdenum etching. The phosphotungstate etchant is best made by first adding base to the tungstate-ferricyanide solution, the adding acid to avoid premature precipitation of a tungsten oxide colloid (as demonstrated earlier in this example) if the pH drops well below pH 7. The phosphate can also be added as its alkali metal derivative.

This etchant is also advantageous over the prior art etchant of hydrogen peroxide and ammonia in that the etchant according to the present invention has an indefinite shelf life whereas the prior art etchant is only stable for about 8 hours.

EXAMPLE 11

The etchant from Example 10 was used to etch tungsten until about 95% of the ferricyanide had been consumed and the etch rate became negligible. The exhausted etchant was then treated with ozone for 40 minutes, during which time the pH rose from 7.02 to 8.08, the solution color changed from yellow to red, and a precipitate settled to the bottom of the beaker. This precipitate was filtered off to yield a clear red rejuvenated etchant, ready for further etching of tungsten.

One advantage of the present invention which is perhaps not readily apparent is that if one would want to adjust the pH of the etching solution below 12 to 13, but above nearly neutral 6 to 8, one could add a heteroatom source, e.g., phosphoric or sulfurous acid, to bring down the pH below 13, but above 6 to 8. The advantage of this use of the invention is that the pH may be adjusted without adverse effects since the phosphate or sulfite does not interfere with the etching process while forming the heteropoly compound.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

What is claimed is:

1. A neutral or near neutral pH etching solution for effectively etching molybdenum and tungsten comprising:

an aqueous ferricyanide ion solution, a soluble molybdate or tungstate, and an essential compound such that upon combination of said soluble molybdate or tungstate and said essential compound, a heteropoly compound is formed in which said essential compound contributes at least one heteroatom to said heteropoly compound.

2. The etching solution of claim 1 wherein said essential compound is phosphoric acid and said heteroatom is phosphorus.

3. The etching solution of claim 1 wherein said essential compound is sulfurous acid and said heteroatom is sulfur.

4. The etching solution of claim 1 wherein said soluble molybdate is sodium molybdate.

5. The etching solution of claim 4 wherein the pH of said solution is in the range of about 7 to 8.

6. The etching solution of claim 1 wherein said soluble tungstate is sodium tungstate.

7. The etching solution of claim 6 wherein the pH of said solution is in the range of about 6 to 8.

8. The etching solution of claim 1 further comprising a charge balancing species.

9. The etching solution of claim 8 wherein said charge balancing species is selected from the group consisting of sodium, potassium, and ammonium ions.

10. The etching solution of claim 1 wherein said etching solution is at room temperature.

11. A method of effectively etching molybdenum or tungsten from a composite material comprising molydenum or tungsten adhered to a base-sensitive material without damaging the material comprising the steps of:

contacting the composite with a neutral or near neutral pH etching solution comprising:

an aqueous ferricyanide ion solution, a soluble molybdate or tungstate, and an essential compound such that upon combination of said soluble molybdate or tungstate and said essential compound, a heteropoly compound is formed in which said compound ingredient contributes at least one heteroatom to said heteropolycompound.

12. The method of claim 11 wherein said essential compound is phosphoric acid and said heteroatom is phosphorus.

13. The method of claim 11 wherein said essential compound is sulfurous acid and said heteroatom is sulfur.

14. The method of claim 11 wherein said soluble molybdate is sodium molybdate.

15. The method of claim 14 wherein the pH of said solution is in the range of about 7 to 8.

16. The method of claim 11 wherein said soluble tungstate is sodium tungstate.

17. The method of claim 16 wherein the pH of said solution is in the range of about 6 to 8.

18. The method of claim 11 further comprising a charge balancing species.

19. The method of claim 18 wherein said charge balancing species is selected from the group consisting of sodium, potassium, and ammonium ions.

20. The method of claim 11 wherein said etching solution is at room temperature.

21. The method of claim 11 further comprising the step of introducing ozone into said etching solution to rejuvenate said solution.

* * * * *